US007849542B2

(12) United States Patent
DeFranks

(10) Patent No.: US 7,849,542 B2
(45) **Date of Patent: *Dec. 14, 2010**

(54) MATTRESSES HAVING FLAME RESISTANT PANEL

(75) Inventor: Michael S. DeFranks, Decatur, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 1123 days.

This patent is subject to a terminal disclaimer.

(21) Appl. No.: 11/472,912

(22) Filed: Jun. 21, 2006

(65) Prior Publication Data

US 2007/0298668 A1 Dec. 27, 2007

(51) Int. Cl.
*A47C 27/00* (2006.01)

(52) U.S. Cl. ..... 5/699; 5/698

(58) Field of Classification Search ..... 005/690, 005/698, 699, 954; 428/920, 921; 174/28; 442/136, 414
See application file for complete search history.

(56) References Cited

U.S. PATENT DOCUMENTS

| | | | |
|---|---|---|---|
| 3,661,691 | A | 5/1972 | Slosberg |
| 4,746,565 | A | 5/1988 | Bafford et al. |
| 4,774,044 | A | 9/1988 | Cline et al. |
| 5,316,834 | A | 5/1994 | Matsuda et al. |
| 5,540,980 | A | 7/1996 | Tolbert et al. |
| 5,902,753 | A | 5/1999 | DeMott et al. |
| 5,912,067 | A | 6/1999 | Stellini |
| 6,265,082 | B1 | 7/2001 | Dunham et al. |
| 6,500,775 | B1 | 12/2002 | Mantegna |
| 6,609,261 | B1 | 8/2003 | Mortensen et al. |
| 6,713,411 | B2 | 3/2004 | Cox et al. |
| 6,858,550 | B2 | 2/2005 | Ahluwalia |
| 6,989,194 | B2 | 1/2006 | Bansal et al. |
| 2003/0082972 | A1 | 5/2003 | Monfalcone et al. |
| 2003/0167580 | A1 | 9/2003 | Lunsford et al. |
| 2003/0225193 | A1 | 12/2003 | Ben-Daat et al. |
| 2003/0228460 | A1 | 12/2003 | Ahluwalia |

(Continued)

FOREIGN PATENT DOCUMENTS

| | | |
|---|---|---|
| EP | 1 273 608 A | 1/2003 |

OTHER PUBLICATIONS

Anonymous: "Restonic Selects GE's ULTEM* FR Resin For New Mattress To Meet Tough Open Flame Standards", Furniture World Magazine, [Online], Feb. 16, 2005, XP002492483, Retrieved from the Internet: URL:http://www.furninfo.com/absolutenm/templates/News.asp?articleid=4812&zoneid=8>, [retrieved on Aug. 14, 2008].

(Continued)

*Primary Examiner*—Arti Singh-Pandey
(74) *Attorney, Agent, or Firm*—Ropes & Gray LLP

(57) ABSTRACT

Mattresses and methods for manufacturing mattresses that have a flame resistant panel, such as a flame resistant border panel. The systems and methods include mattresses that have a flame resistant panel that, in certain embodiments, includes a fire barrier layer made of a batting material and being disposed over a thermoplastic fire barrier layer. The first and second fire barrier layers provide a fire barrier that reduces the transfer of oxygen to the mattress core, thereby reducing the presence of oxygen, which is needed to support combustion of the padding material. Additionally, the invention encompasses methods for manufacturing mattresses.

19 Claims, 9 Drawing Sheets

U.S. PATENT DOCUMENTS

| | | | |
|---|---|---|---|
| 2004/0121114 | A1 | 6/2004 | Piana et al. |
| 2004/0176008 | A1 | 9/2004 | Lampe |
| 2004/0214495 | A1 | 10/2004 | Foss et al. |
| 2004/0229053 | A1 | 11/2004 | Ahluwalia et al. |
| 2005/0026528 | A1 | 2/2005 | Forsten et al. |
| 2005/0095936 | A1 | 5/2005 | Jones et al. |
| 2005/0170732 | A1 | 8/2005 | Knoff |
| 2005/0183202 | A1 | 8/2005 | Diaz |
| 2005/0215152 | A1 | 9/2005 | Ahluwalia |
| 2005/0215158 | A1 | 9/2005 | Hartgrove et al. |
| 2005/0227558 | A1 | 10/2005 | Small et al. |
| 2005/0245164 | A1 | 11/2005 | Aneja et al. |
| 2006/0075567 | A1 | 4/2006 | DeFranks |

OTHER PUBLICATIONS

International Search Report dated Aug. 28, 2008 in International Application No. PCT/US2007/014334.

Mass Loss ½ oz SF

Thermal Transmission ½ oz SF

MATTRESSES HAVING FLAME RESISTANT PANEL

BACKGROUND OF THE INVENTION

Today, there is an increasing interest in adding flame resistant characteristics to mattresses and other furniture.

Materials that can resist flame and fire have been known for many years. Asbestos, Kevlar, halogen treated fabrics, thermoplastics and other materials have long been used to reduce and prevent combustion. Although these materials work well, not all are suited for every use and need. Flame resistance has been added to clothing, work gloves and other items for may years with reasonable success. One such example is disclosed in U.S. Pat. No. 6,713,411, issued to Cox et al. Cox et al. describe a flame resistant material that is a laminate having a first layer of a spun lace fabric having a fire retardant additive and a second layer of a polymeric film. The material works well to resist flame and has been used for workgloves, and protective coverings for machinery. However, work gloves and protective coverings are in essence specialty products where the ability to resist flames is the primary function.

One difficulty of adding flame resistance to a mattress is that mattresses by their nature require soft padded surfaces. The padding acts as a source of fuel which can ignite if sufficient heat passes through a fire barrier, even if flames are kept from contacting the padding. Therefore, a high degree of flame resistance is required and must be provided without making the mattress to stiff or causing it to release obnoxious odors.

Several solutions have been proposed. Among them is U.S. Pat. No. 4,504,991 to Klancnik that describes a fire resistant mattress having a flame retardant two layer composite material. This composite material will form a char upon sufficient exposure to a flame. The composite material is a neoprene foam bonded to a fiberglass fabric. U.S. Pat. No. 6,823,548 to Murphy et al. also discloses a fire barrier fabric for use with a mattress. The fire barrier is used with an insulating layer to enclose, at least partially, the core of an open flame resistant mattress. The mattress core is surrounded, at least, partially, by the fire barrier to prevent the core from combusting.

Although the fabrics described in these publications work well, they are generally quite expensive and add, sometimes significantly, to the cost of a mattress. Thus, there exists a need for effective fire barrier materials that will not add a significant cost burden to a consumer.

SUMMARY OF THE INVENTION

The systems and methods described herein include mattresses and methods for manufacturing mattresses that have a flame resistant panel, such as a flame resistant border panel. In particular, the systems and methods described herein include mattresses that have a flame resistant panel that, in certain embodiments, includes a fire barrier layer made of a batting material and being disposed adjacent a thermoplastic fire barrier layer, both fire barrier layers being part of a quilted panel that covers the inner core of the mattress. The first and second fire barrier layers provide a fire barrier that reduces the transfer of oxygen to the padding material, thereby reducing the oxygen needed to support combustion of the padding material. The thermoplastic layer may be used to reduce the amount of fire resistant batting layer used and thereby reduce manufacturing costs. Additionally, the invention encompasses methods for manufacturing mattresses.

In one particular aspect, the systems and methods described herein include a mattress construction comprising an inner core and a flame resistant layer positioned at or adjacent to the inner core, the flame resistant layer may have a fabric layer formed of fibers and a flame resistant thermoplastic laminated to the fabric layer, wherein the flame resistant thermoplastic forms a substantially continuous flame resistant barrier layer. The different layers may be joined together and for example the flame resistant thermoplastic may be heat bonded, with one sheet laid against the other in planar arrangement, to the fabric layer, or the flame resistant thermoplastic may be pressure bonded, ultrasonically or adhesively bonded, or bonded or joined in any other suitable way to the other layer. In other practices the flame resistant thermoplastic may be heated to its transition temperature so that it flows through a surface of the fabric layer and into the fibers, and/or into the interstices between the fibers. Optionally, surfaces of the fibers and the flame resistant thermoplastic may be fused together.

The flame resistant thermoplastic may be present in sufficient mass and/or volume to render the flame resistant layer substantially impervious to air. In one embodiment, the flame resistant thermoplastic forms a layer having a thickness between 0.1 mils and 5 mils.

The fabric layer may include at least one of flame resistant fibers or a flame resistant additive and that may include at least one of aramid, meta-aramid, para-aramid, polyamide-imide, polyimide, melamine, modacrylic, polybenzimidazole, glass fibers, or carbon fibers. Further, the flame resistant additive may include at least one of a phosphorus-based additive, an antimony-based additive, a bromine-based additive, ammonium polyphosphate, ammonium dihydrogen phosphate, colloidal antimony pentoxide, antimony trioxide, sodium antimonite, zinc borate, zirconium oxides, diammonium phosphate, sulfamic acid, salts of sulfamic acid, boric acid, salts of boric acid, or hydrated alumina. Further, the fabric layer includes at least one of cotton, polyester, vinyl, linen, silk, wool, latex, acrylic, polypropylene, rayon, bamboo, hemp, cashmere, or modal. The flame resistant thermoplastic may be any suitable thermoplastic such as including at least one of amorphous Polyetherimide, Polypropylene, Nylon, Polycarbonate, Acrylonitrile Butadiene Styrene, Polybutylene Terephthalate, Polycarbonate/ABS Alloy, or Polycarbonate/Acrylic Alloy.

The flame resistant layer may be used as an outermost layer of upholstery and may be positioned at or adjacent a side of the inner core. Optionally, a second flame resistant layer may be disposed beneath upholstery and above the inner core of the mattress. A non-woven batting layer may be placed adjacent to the flame resistant layer; and a fabric backing layer adjacent to the non-woven batting layer. In one embodiment the flame resistant thermoplastic includes amorphous polyetherimide, the fabric layer includes at least one of polypropylene or polyester, the non-woven batting layer includes flame resistant rayon and polyester, and the fabric backing layer includes polypropylene.

In another aspect, the systems and methods described herein include methods of manufacturing a flame resistant layer, comprising overlaying a film made of a flame resistant thermoplastic onto a surface of a fire resistant fabric layer formed of fibers, and adhering the film to said fibers, wherein the flame resistant thermoplastic forms a substantially continuous flame resistant barrier layer. The step of adhering may include applying heat sufficient to cause the flame resistant thermoplastic to penetrate said fibers, and cause the fiber surfaces to soften and the flame resistant thermoplastic to fuse with the fiber surfaces. In certain practices the fabric layer has interstices interspersed throughout the fibers and applying sufficient heat causes the flame resistant thermoplastic to cover said interstices.

BRIEF DESCRIPTION OF THE DRAWINGS

The foregoing and other objects and advantages of the invention will be appreciated more fully from the following further description thereof, with reference to the accompanying drawings wherein.

DESCRIPTION OF THE ILLUSTRATED EMBODIMENTS

To provide an overall understanding of the invention, certain illustrative embodiments will now be described, including a mattress that has a side border panel that includes a thermoplastic layer and a layer of fire resistant material. However, it will be understood by one of ordinary skill in the art that the systems and methods described herein can be adapted and modified and applied in other applications and that such other additions, modifications and uses will not depart from the scope hereof.

Figure 1:
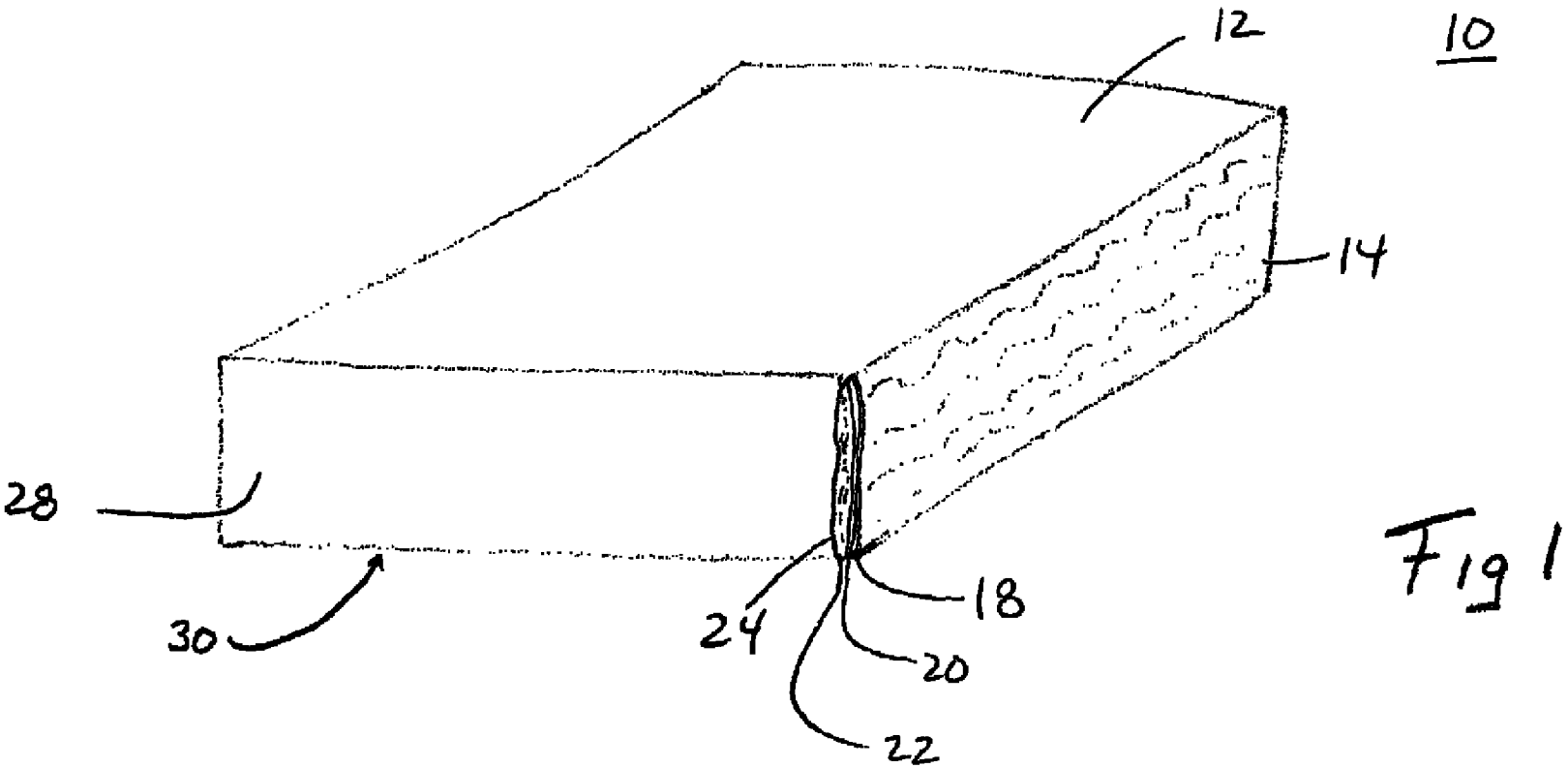
FIG. 1 illustrates one embodiment of a mattress having fire resistant panel according to the invention.

The systems and methods disclosed herein will now be described with reference to certain exemplary embodiments set out in the figures. To this end, FIG. 1 represents one embodiment of a mattress according to the invention. The mattress 10 of FIG. 1 provides fire resistance and in the embodiment depicted in FIG. 1 the mattress 10 includes a top quilted panel 12 that extends across the top surface of the mattress 10 to provide a sleeping surface and includes one or more side border panels 14 and 28 that extend across the sides, head and foot of the mattress 10.

In the embodiment depicted in FIG. 1, the top quilted panel 12 is different from the side border quilted panels 14 and 28. In this embodiment, the quilted panel 12 is a padded quilted sleeping surface that has a fire barrier, that, in this embodiment may be a single layer of Fire Gard® that extends across the full length and width of the quilted panel 12. In optional alternative embodiments, the fire barrier may be provided as a tube of material that surrounds a foam pad provided as a support layer, and the encased foam pad may be covered by a layer of ticking. In any case, it will be understood by those of skill in the art, that in the mattresses depicted in FIG. 1, the side border panel may employ a different type of fire barrier than the quilted panel 12 used as a sleeping surface.

For this depicted embodiment, the border panels 14 and 28 are made differently from the upper quilted panel 12. In particular, the border panel 14 as depicted in FIG. 1 includes an outer fabric layer 18, optionally of polypropylene ticking and further optionally being a fire barrier material, a thermoplastic layer 20 is disposed beneath fabric layer 18, and a layer of fire resistant fiber batting 22 and a backing layer 24 are placed under the thermoplastic layer 20. In the embodiment depicted in FIG. 1 the side board of panel 28 may be similarly constructed as the quilted side border panel 14 and, in this embodiment a bottom panel 30 (not shown) may also be provided that includes a similar construction as the side border panels 14 and 28, although the outer ticking layer 18 may be replaced with a non woven fabric with less aesthetic appeal. For example, one sided mattresses may use such a modified version of this fire barrier material on its lower non-sleeping side. In such a mattress, the bottom layer fire barrier may be a multi-layer material that is a low loft or fabric style bottom layer. This can provide a useful barrier with a less costly material as the aesthetic concerns of the material are less pressing for the bottom layer of a one-sided mattress. This multi-layer material may extend across, or substantially across, the exterior surface of the bottom face of the one-sided mattress. The multiple layers can include a spun bonded polyurethane layer, a layer of treated rayon flame resistant material placed over the polyurethane and then a layer of thermoplastic film. Other embodiments may also be used without departing from the scope of the invention. The mattress 10 depicted in FIG. 1 includes an upper quilted panel 12 that includes a fire barrier layer and side border panels and a bottom panel, 14, 28, and 30 respectively that have a fire barrier formed from two layers of fire resistant material.

Figure 2:
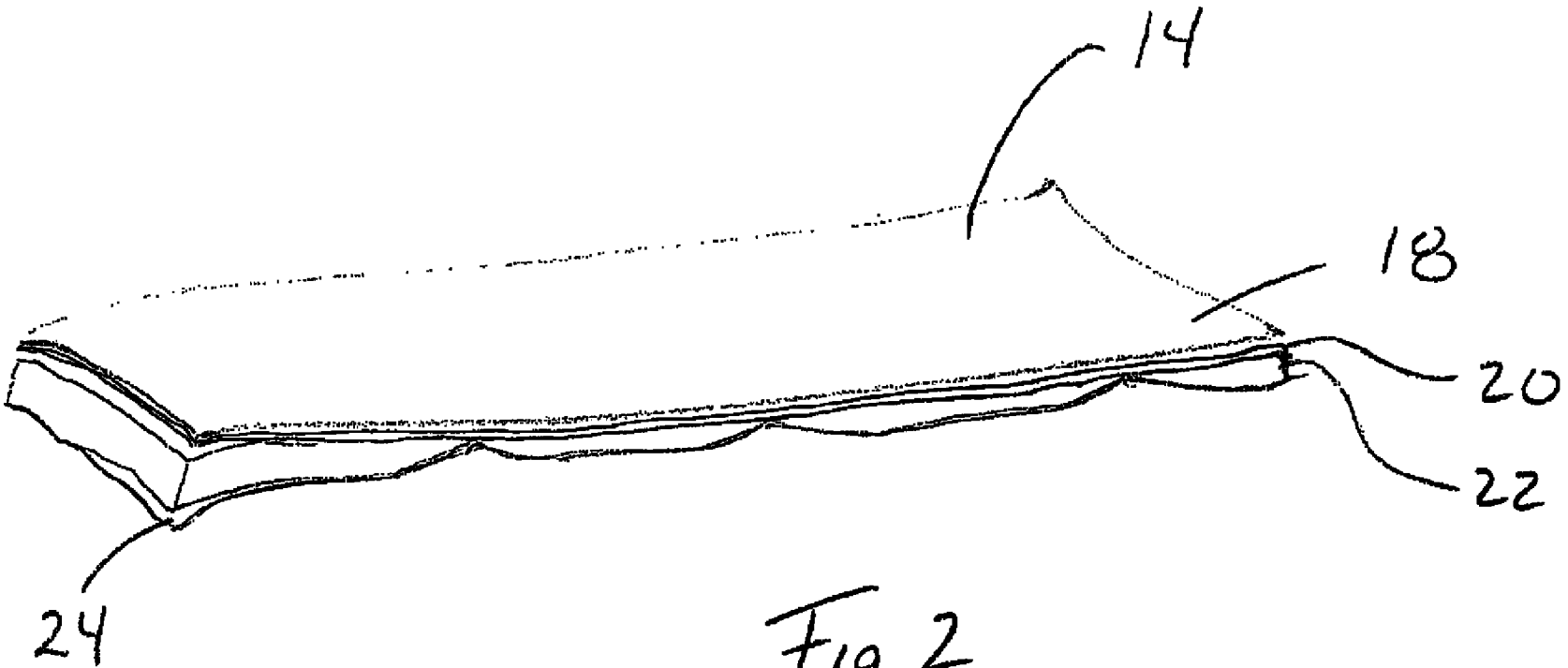
FIG. 2 depicts the in more detail a cut away and exploded view of a border panel used with the mattress of FIG. 1.

FIG. 2 depicts in more detail one example of the side border panel 14 that includes a two-layer fire barrier. In particular, FIG. 2 depicts a strip of the side border panel 14. This strip includes a layer 18 of polyester woven fabric, a first fire barrier 20 that in this embodiment comprises a thermoplastic film such as the ULTEM, or VALOX film manufactured and sold by GE. Other commercially available flame retardant thermoplastic films may also be used, including other thermoplastic polymer resins based on polybutylene terephthalate (PBT) polymers. Below the first fire barrier 20 is a second fire barrier layer 22 that in this embodiment comprises a non-woven batting material such as a layer of half ounce fire resistant rayon-polyester batting. Disposed below the second fire barrier layer 22 is a backing layer 24 that may be a polypropylene material or other similar kind of material suitable for providing a backing layer for the quilted side border 14.

In one optional embodiment, the thermoplastic film 20 is coupled to the fabric layer 18 to provide a unitized assembly that can be put into existing production lines. For example, the thermoplastic film may be adhesively bonded with the fabric layer 18 to provide a composite material that can be cut and fed through existing quilting machines for the purpose of forming side border panels such as the side border panel 14 depicted in FIG. 1. In alternative embodiments, the thermoplastic film 20 and the fabric material 18 may be bonded together through the application of heat. For example, the thermoplastic film 20 may be heated to a point where it is capable of flowing into and between the fibers of the fabric 18. Preferably, the thermoplastic film is flowed into the interstices of the fiber 18 so that a continuous layer of thermoplastic material is formed on one side of the fabric 18. Such a process is described in more detail below with reference to FIG. 10. Additionally, it will be realized that additional padding and layers may be added to the side border panel without departing from the scope of the invention and that the filling and fabric materials selected will vary according to the application. Further, the embodiment of FIG. 2 employs an ULTEM thermoplastic film, however the film employed may vary without departing from the scope of the invention.

It is a realization of the present invention that the side border panels 14 and 28 of the mattress 10 may employ two different types of fire resistant materials to provide a combined fire resistance capable of meeting current standards, including the California Technical Bulletin TB 603 Requirements and Test and the Open Flame Mattress Flammability Standard as set out in 16 C.F.R. §1633 et seq. It is a further realization that by employing a thin thermoplastic film layer, such as the depicted thermoplastic film layer 20, the amount of fire resistant rayon/polyester batting needed to meet the standards noted above may be reduced, which in turn can reduce the overall cost of providing a fire resistant side border, as thermoplastic film is a less expensive material with a fire resistant characteristic.

Figure 3:
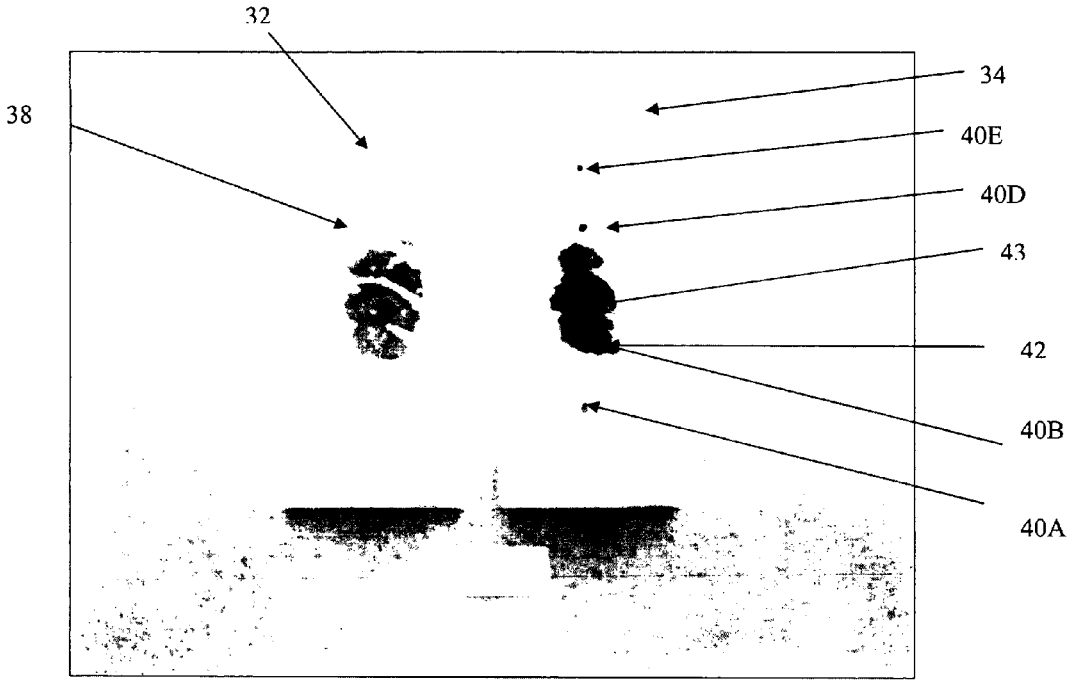
FIG. 3 depicts the front side and back side of two exemplary sections of side border and illustrates thermal coupling measurement points.

Turning to FIG. 3 there are depicted two samples of side border panel comprising half ounce per square foot fire retardant fiber batting, and in particular fire retardant fiber adding of the type manufactured by Western Non-Woven, Inc. and sold under the brand name TB20-80. 0.50 OSF. In particular, FIG. 3 depicts two samples, 32 and 34, of side border panel each of which has been tested by exposure to an open flame The sample 32 has a centrally located burn mark 38 that occurs at the location or generally at the location where an open flame was applied to the sample 32. The sample 32 is presented so that the outer fabric layer 18 is forward facing. The open flame was applied to the fabric layer 18 for a set period of time and then removed. FIG. 3 further depicts the sample 34 that is also a portion of side border panel formed from a half ounce per square foot fire retardant batting material purchased from the Western Non-Woven Incorporated Company with a layer of thermoplastic disposed between the outer fabric layer 18 and the Western Non-Woven fire retardant batting 22.

In FIG. 3 the sample 34 is presented so that the backing layer 18 is upwardly facing and the center burn 43 is the section of the side border panel 34 that was burned by the open flame applied to the outer surface of the sample 34. Thus the section 43 represents an area of heat transfer sufficient to degrade the properties of the polypropylene non-woven backing. Sample 34 also depicts a set of thermal coupling measurement points 40A-40E, with 40C not shown as it occurs within the center of the darkened burned area. These points move upwardly from the bottom of the sample towards the top of the sample.

As described above, during the open flame test the border sample is positioned at an angle of about 45° so that the open flame contacting the surface 18 of the sample tends to generate heat which moves upwardly traveling from lower thermal coupling points to the higher thermal coupling points. Measurements of the temperature were taken at each of the thermal coupling points and recorded. These measured temperatures are representative of the heat that would be passed through a fire barrier constructed as the side border panels 32 and 34 are constructed with a half-ounce fire retardant batting and a 3 mil film of ULTEM thermoplastic film. It will be understood that heat passing through the side border panel results in the delivery of energy to the core of the mattress. The core of the mattress can act as fuel and under certain conditions of heat and oxygen will combust. It can be noted from the samples depicted in FIG. 3 that the integrity of the side border panels 32 and 34 were not breached during testing. That is, upon examination of the samples 32 and 34 one can see that the side border panel remained in tact and that through-holes were not formed within the side border panel. As such it is understood that the side border panel maintained sufficient integrity to bar or at least retard the flow of oxygen from outside of the mattress to inside the mattress where the core is. By depriving the inside of the mattress of oxygen, even the application of certain amounts of heat and energy will not result in combustion. As such the fire barrier side border piece is understood to provide sufficient resistance to combustion to satisfy the standards set forth in established standards, such as California Technical Bulletin TB 603 Requirements and Test and the Open Flame Mattress Flammability Standard as set out in 16 C.F.R. §1633 et seq.

Figure 4:
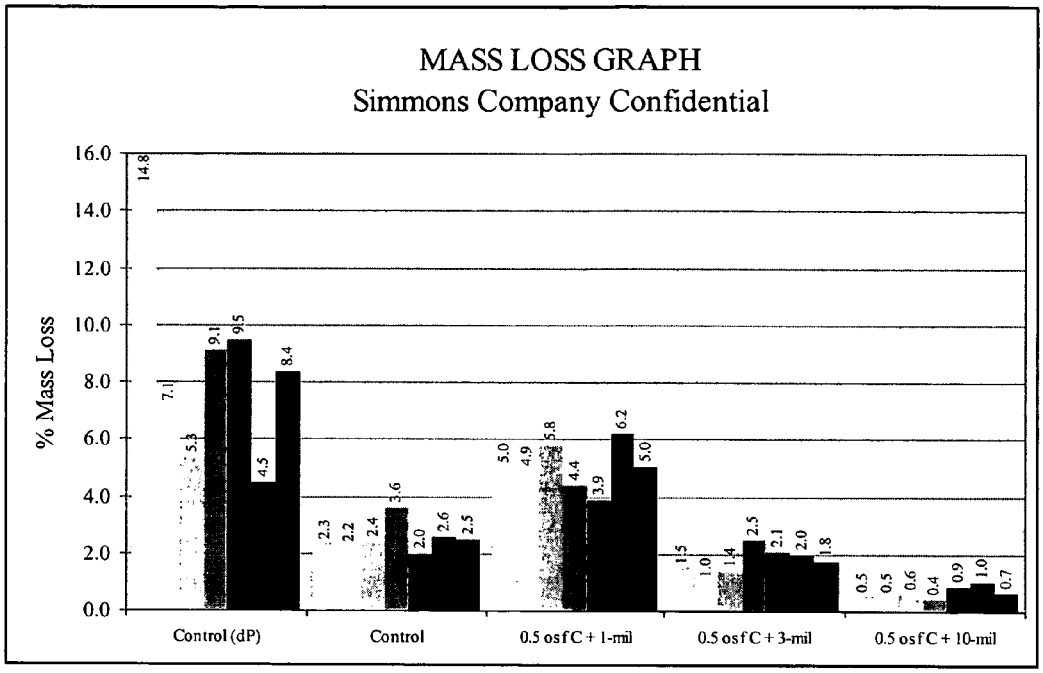
FIG. 4 illustrates a graph showing experimental data of mass loss taken from a sample similar to the samples shown in FIG. 3.

FIG. 4 depicts the mass loss that occurred for several different sample side border panel configurations. In particular, FIG. 4 depicts a graph that has on its X axis the percentage of mass loss that occurred during flame exposure testing. Mass loss measures the loss of mass that occurs within the sample side border piece. The graph in FIG. 4 has an X axis that indicates the type of sample being tested. As shown in FIG. 4, the samples tested include a control sample (DP) a second control sample, the control dp material was Dupont hL 1 LL with a basis weight of 1.25 osf. The control material was western non-woven industries TB 20-80 with a basis weight of 1.0 osf (a fire retardant rayon/polyester material) a side border panel having a half-ounce of fire retardant batting with a 1 mils thermoplastic ULTEM layer, a forth sample having a half ounce fire retardant fiber batting with a 3 mils thermoplastic ULTEM layer, and a fifth sample having a half-ounce fire retardant fire barrier with a 10 mils ULTEM thermoplastic layer. The graph in FIG. 4 presents the data from Table 1.

TABLE 1

| | | | | | | | |
|---|---|---|---|---|---|---|---|
| Control (dP) | 14.8 | 7.1 | 5.3 | 9.1 | 9.5 | 4.5 | 8.4 |
| Control | 2.3 | 2.2 | 2.4 | 3.6 | 2.0 | 2.6 | 2.5 |
| 0.5 osf C + 1-mil | 5.0 | 4.9 | 5.8 | 4.4 | 3.9 | 6.2 | 5.0 |
| 0.5 osf C + 3-mil | 1.5 | 1.0 | 1.4 | 2.5 | 2.1 | 2.0 | 1.8 |
| 0.5 osf C + 10-mil | 0.5 | 0.5 | 0.6 | 0.4 | 0.9 | 1.0 | 0.7 |

As indicated, the increasing amount of fire retardant material causes a decrease in the percentage of mass loss from sample size to sample size. For example, the control (DP) has the greatest amount of mass loss and the second control sample has a lesser mass loss. The three tested side border panels (each with the two-part fire retardant barrier) provided increasing fire resistance with increasing thickness of the thermoplastic layer. As can be seen from FIG. 4, the 1 mils thermoplastic layer sample provided less protection against mass loss than the control sample. However, the 3 mils thermoplastic layer sampled provided better protection than the control sample and the 10 mils sample provided better protection still.

Figure 5:
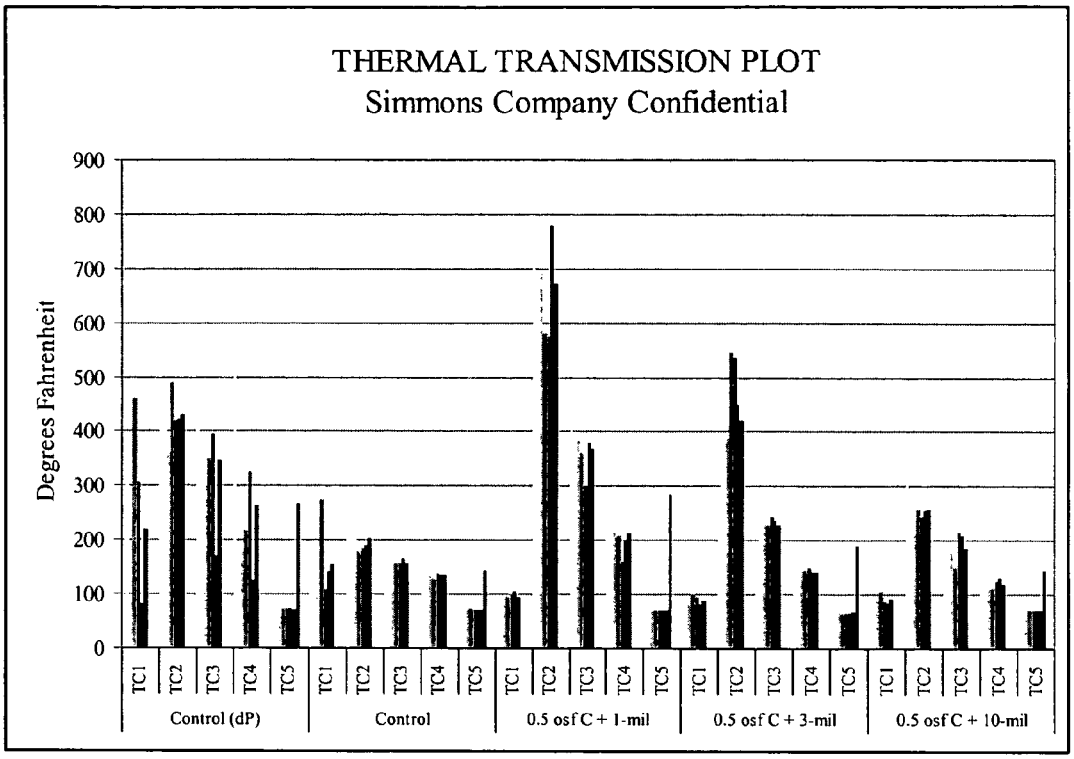
FIG. 5 depicts a graph showing thermal transmission across different thermal coupling points.

Turning to FIG. 5 a thermal transmission plot is provided. The X axis of the thermal transmission plot depicts the degrees in Fahrenheit that were measured at different thermal coupling points. The X axis indicates, for each sample, the set of thermal coupling points at which measurements were taken. These thermal coupling points shown in FIG. 5 correspond to the thermal coupling points 40A-40E shown in FIG. 3. Measurements of the temperature were taken with a thermocouple placed against the sample. FIG. 5 graphs the data from Table II below.

TABLE II

| Sample | Couple | MEASURED TEMPERATURES | | | | | | | AVG Temp |
|---|---|---|---|---|---|---|---|---|---|
| Control (dP) | TC1 | 85 | 300 | 82 | 460 | 306 | 80 | 218.8 | 266.4 |
| | TC2 | 446 | 445 | 360 | 492 | 420 | 423 | 431.0 | |
| | TC3 | 485 | 375 | 302 | 350 | 395 | 170 | 346.2 | |
| | TC4 | 553 | 187 | 176 | 218 | 325 | 125 | 264.0 | |
| | TC5 | 72 | 70 | 72 | 72 | 73 | 72 | 71.8 | |
| Control | TC1 | 127 | 136 | 136 | 275 | 109 | 141 | 154.0 | 144.13 |
| | TC2 | 222 | 222 | 216 | 178 | 185 | 190 | 202.2 | |
| | TC3 | 150 | 161 | 155 | 158 | 158 | 166 | 158.0 | |
| | TC4 | 140 | 134 | 135 | 128 | 137 | 135 | 134.8 | |
| | TC5 | 73 | 71 | 71 | 73 | 71 | 71 | 71.7 | |
| 0.5 osf C + 1-mil | TC1 | 85 | 85 | 96 | 96 | 100 | 105 | 94.5 | 283.83 |
| | TC2 | 740 | 660 | 695 | 580 | 575 | 778 | 671.3 | |
| | TC3 | 400 | 385 | 385 | 360 | 302 | 380 | 368.7 | |
| | TC4 | 260 | 245 | 215 | 210 | 160 | 200 | 215.0 | |
| | TC5 | 69 | 69 | 70 | 70 | 70 | 70 | 69.7 | |
| 0.5 osf C + 3-mil | TC1 | 96 | 85 | 85 | 100 | 95 | 80 | 90.2 | 188.9 |
| | TC2 | 285 | 310 | 388 | 545 | 538 | 450 | 419.3 | |
| | TC3 | 185 | 215 | 262 | 228 | 245 | 235 | 228.3 | |
| | TC4 | 120 | 140 | 145 | 145 | 150 | 140 | 140.0 | |
| | TC5 | 70 | 68 | 68 | 65 | 65 | 65 | 66.8 | |
| 0.5 osf C + 10-mil | TC1 | 88 | 90 | 90 | 105 | 88 | 85 | 91.0 | 144.8 |
| | TC2 | 300 | 280 | 215 | 258 | 245 | 255 | 258.8 | |
| | TC3 | 185 | 165 | 180 | 149 | 215 | 210 | 184.0 | |
| | TC4 | 130 | 110 | 115 | 110 | 125 | 130 | 120.0 | |
| | TC5 | 70 | 70 | 70 | 70 | 70 | 70 | 70.0 | |

As can be seen in FIG. 5 the thermal transmission plot for the sample having a half-ounce of fire resistant batting with a 1 mils thermoplastic layer is greater than the thermal transmission that occurred with either of the controls samples. The thermal transmission with the sample have a 3 mils thermoplastic layer is comparable to the thermal transmission of the first control sample with an average transmission number of about 189 degrees Fahrenheit compared to the average transmission of 266 for the first control sample and 144 for the second control sample. The thermal transmission for the sample having a 10 mils of thermoplastic layer is still further improved and the average transmission temperature is 145 degrees Fahrenheit, comparable to that of the control sample.

Figure 6:
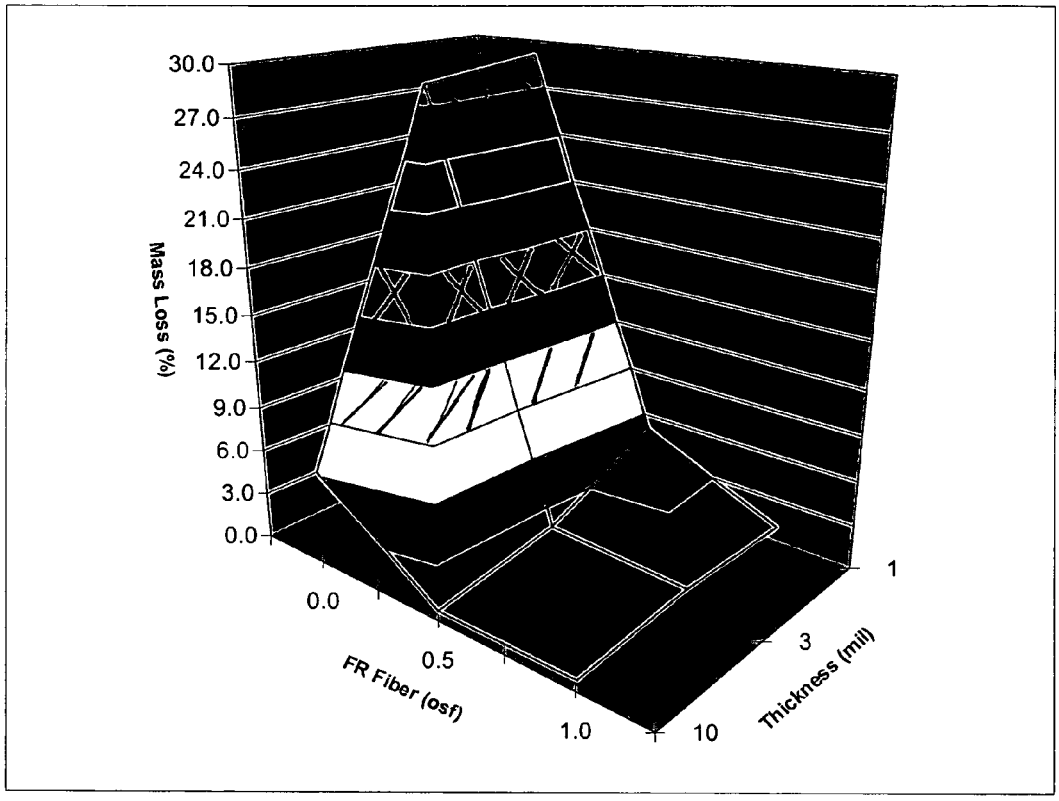
FIG. 6 is a three dimensional plot of percentage of mass loss characteristics for varying characteristics of fiber batting weight and thickness of thermoplastic film.

The experiments described above provide a data set that is aggregated and depicted in FIG. 6 which shows the measure of mass loss, thickness of the FR fiber batting layer and thickness of the thermal plastic layer as a single plot. In this diagram it is understood that mass loss is a good indicator of how much or how little combustion took place due to flame exposure. Reduced mass indicates combustion. The less mass reduced indicates the greater the level of flame resistance. Accordingly, the data presented in FIG. 6 can help select the combination of thickness for the thermal plastic layer and thickness and weight for the FR fiber batting that can be used to achieve the appropriate amount of fire resistance to meet California Technical Bulletin TB 603 Requirements and Test and the Open Flame Mattress Flammability Standard as set out in 16 C.F.R. §1633 et seq.

Figure 7:
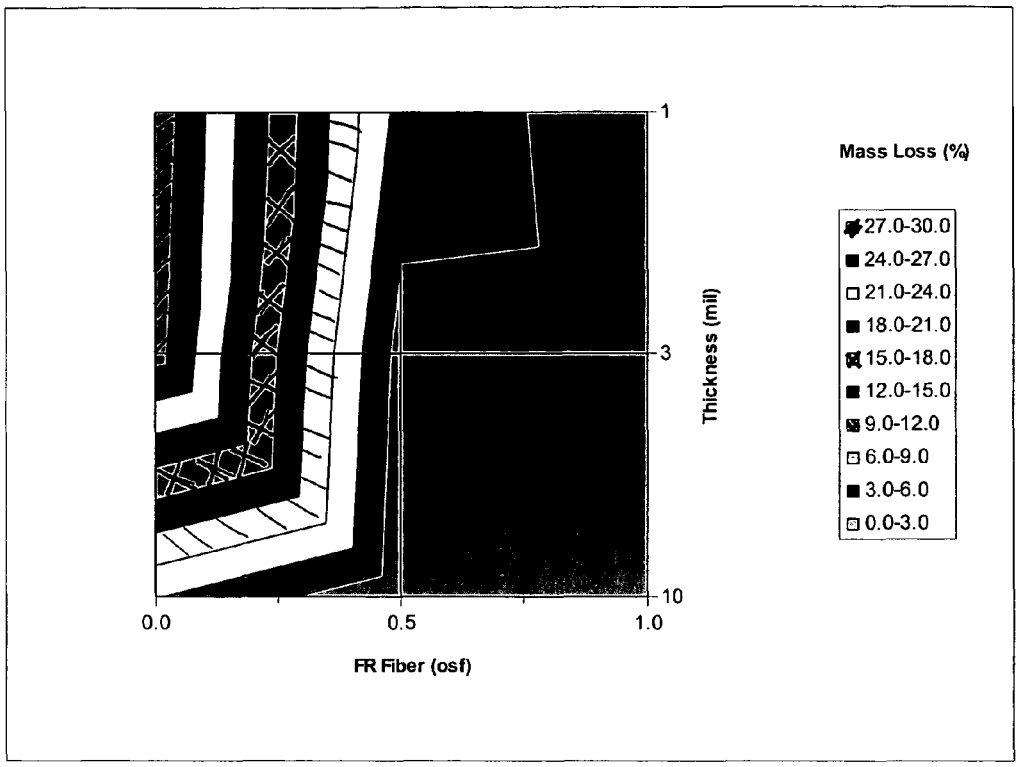
FIG. 7 is a two dimensional plot of the data set out in the plot shown in FIG. 6.
Figure 8:
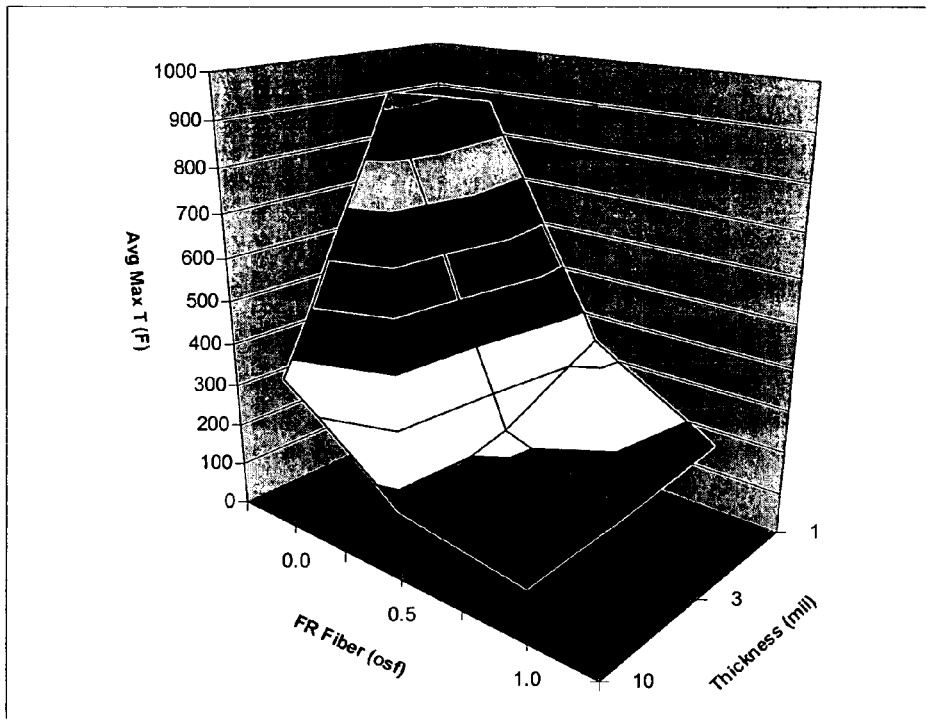
FIG. 8 is a three dimensional plot of thermal transmission characteristics for varying characteristics of fiber batting weight and thickness of thermoplastic film.
Figure 9:
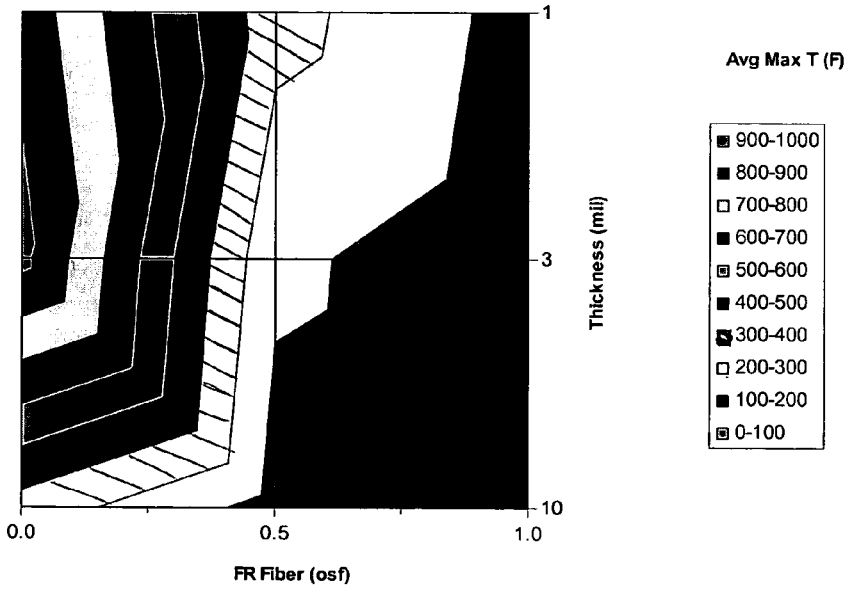
FIG. 9 is a two dimensional plot of the data set out in the plot shown in FIG. 8.

FIG. 7 depicts this data in an alternate form. In particular, FIG. 7 shows a 2 dimensional graph that plots thickness of thermoplastic layer along the Y axis and basis weight of the fiber batting on the X axis. Presented in grey scale is the mass loss that occurred. Within the section that corresponds to the grey scale representing mass loss % of 3.0-6.0 as set out in the reference key on the right side of FIG. 7 is the performance of the sample that had a half-ounce FR fiber batting over a 3 mil thermoplastic film. FIG. 8 depicts the thermal transmission characteristics for varying characteristics of fiber batting weight and thickness of thermoplastic film. In particular, the Z-axis of FIG. 8 presents the Average Maximum Temperature transmitted through the barrier, the Y-Axis presents the thickness in mils of the thermoplastic layer and the X-axis depicts the weight of the FR fiber batting. FIG. 8 shows that the average temperature transmission through the barrier increases as the thickness of the film decreases and as the weight of the FR batting decreases. FIG. 9 is a two dimensional plot of the data set out in the plot shown in FIG. 8, with the grey scale coded heat transmission key shown to the right of the plot. To understand the combination of film thickness and fiber weight that would be useful as a fire barrier, the data from control samples was taken. From this data it was determined that thermal transfer for successful control fabrics had temperature transmission kept below 400 to 450°. As such, for one embodiment, the FR barrier developed used film thickness and fiber weight selected to keep thermal transmission in the 300-400° range.

Using the plots set out in FIGS. 8 and 9, it can be seen that a film thickness of 1 mils and a fiber weight of 0.5 osf (once per square foot) keeps thermal transmission in this range. This is understood to keep thermal transmission in a range that will prevent the polyurethane foam in the mattress from beginning to degrade into fluid and gasses and to keep it well below the flash point for the foam. As such, it indicates that a side border formed from these components should provide sufficient protection and flame resistance to meet California Technical Bulletin TB 603 Requirements and Test and the Open Flame Mattress Flammability Standard as set out in 16 C.F.R. §1633 et seq.

Figure 10:
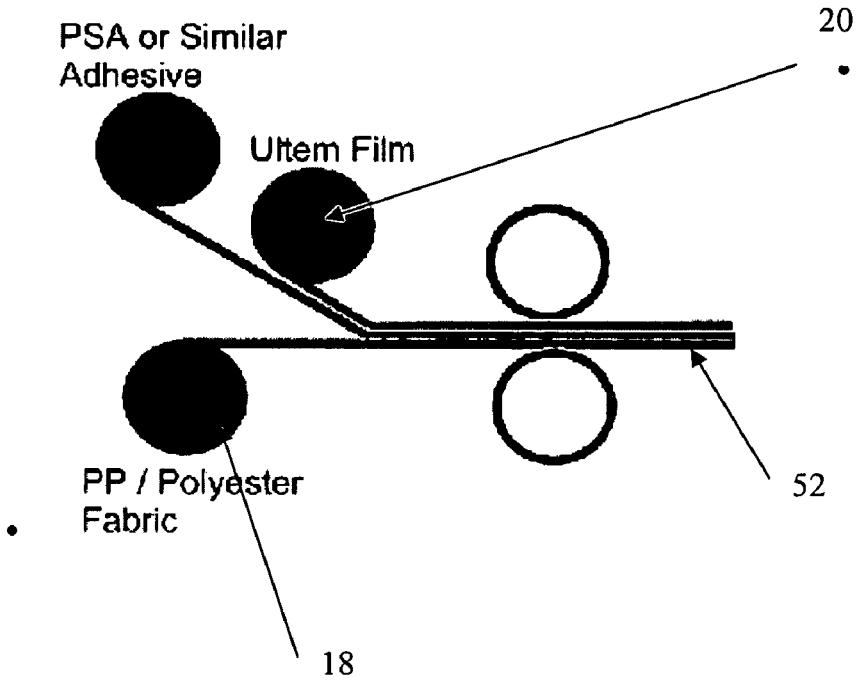
FIG. 10 depicts one process for making a fire resistant panel according to the invention.

Once the components of the fire barrier material are selected, the quilted panels may be made and the mattress constructed. FIG. 10 depicts one process for making one embodiment of the fire barrier material. In particular, FIG. 10 depicts a process for bonding the outer fabric layer 18 to the thermoplastic film 20. In the process shown in FIG. 10, the thermoplastic film 20 is adhesively bonded to the fabric layer 18 by applying an adhesive layer between the thermoplastic and the fabric and compressing the layer together by action of the rollers 50. The resulting material 52 may be used as a material layer that can be processed by a quilting machine and other machines and tools normally employed to manufacture a mattress.

In alternative processes, the thermoplastic layer 20 and the fabric layer 18 may be joined by heating the thermoplastic material to a point that it becomes sufficiently fluid as to flow into the interstices that occur within the weave of the fabric layer 18. The thermoplastic material may be a film that is laid over the fabric and then heated to a temperature of transition to allow it to flow into the interstices of the fabric. The transition temperature of a thermoplastic material is typically a specified characteristic and can be obtained from the supplier or determined by heating the material and measuring its temperature at the point of transition. In other practices, the thermoplastic material may be in a piece or bead form and may be heated to a transition temperature at which point it may be sprayed or flowed over the fabric to form a coating on the fabric. Optionally, the thermoplastic may be applied to both sides of the fabric. The fabric layer 18 may also be heated, often in the same step, to encourage the flow of thermoplastic and the joining and bonding of the thermoplastic with the fabric layer 18. In this embodiment, as with the embodiment described above, the thermoplastic film 20 is coupled to the fabric layer 18 to provide a unitized assembly that can be put into existing production lines. In both cases, the thermoplastic film 20 forms a continuous layer of thermoplastic material across one side of the fabric layer 18. As described above, the continuous layer of thermoplastic film reduces the transfer of oxygen to the padding material in the mattress, thereby reducing the oxygen available to support combustion of the padding material.

Those skilled in the art will know or be able to ascertain using no more than routine experimentation, many equivalents to the embodiments and practices described herein. Accordingly, it will be understood that the invention is not to be limited to the embodiments disclosed herein, but is to be understood from the following claims, which are to be interpreted as broadly as allowed under the law.

I claim:

1. A mattress construction comprising:

an inner core; and a flame resistant layer positioned at or adjacent to the inner core, the flame resistant layer comprising a fabric layer formed of fibers; and a flame resistant thermoplastic laminated to the fabric layer, wherein the flame resistant thermoplastic forms a substantially continuous flame resistant barrier layer.

2. The mattress of claim 1, wherein the flame resistant thermoplastic is heat bonded in planar to the fabric layer.

3. The mattress of claim 1, wherein the flame resistant thermoplastic is pressure bonded in planar to the fabric layer.

4. The mattress of claim 1, wherein the flame resistant thermoplastic is adhered in planar to the fabric layer.

5. The mattress of claim 1, wherein the flame resistant thermoplastic melts through a surface of the fabric layer and into the fibers.

6. The mattress of claim 1, wherein surfaces of the fibers and the flame resistant thermoplastic are fused together.

7. The mattress of claim 1, wherein the fabric layer has interstices interspersed throughout the fibers; and the flame resistant thermoplastic covers said interstices.

8. The mattress of claim 1, wherein the flame resistant thermoplastic has a volume sufficient to render the flame resistant layer substantially impervious to air.

9. The mattress of claim 1, wherein the flame resistant thermoplastic forms a layer having a thickness between 0.5 mils and 5 mils.

10. The mattress of claim 1, wherein the fabric layer includes at least one of flame resistant fibers or a flame resistant additive.

11. The mattress of claim 1, wherein the flame resistant fibers include at least one of aramid, meta-aramid, para-aramid, polyamide-imide, polyimide, melamine, modacrylic, polybenzimidazole, glass fibers, or carbon fibers.

12. The mattress of claim 1, wherein the flame resistant additive includes at least one of a phosphorus-based additive, an antimony-based additive, a bromine-based additive, ammonium polyphosphate, ammonium dihydrogen phosphate, colloidal antimony pentoxide, antimony trioxide, sodium antimonite, zinc borate, zirconium oxides, diammonium phosphate, sulfamic acid, salts of sulfamic acid, boric acid, salts of boric acid, or hydrated alumina.

13. The mattress of claim 1, wherein the flame resistant thermoplastic includes at least one of amorphous Polyetherimide, Polypropylene, Nylon, Polycarbonate, Acrylonitrile Butadiene Styrene, Polybutylene Terephthalate, Polycarbonate/ABS Alloy, or Polycarbonate/Acrylic Alloy.

14. The mattress of claim 1, wherein the fabric layer includes at least one of cotton, polyester, vinyl, linen, silk, wool, latex, acrylic, polypropylene, rayon, bamboo, hemp, cashmere, or modal.

15. The mattress of claim 1, wherein the flame resistant layer is used as an outermost layer of upholstery.

16. The mattress of claim 1, wherein the flame resistant layer is positioned at or adjacent a side of the inner core.

17. The mattress of claim 1, further comprising a second flame resistant layer disposed beneath upholstery and above the inner core of the mattress.

18. The mattress of claim 1, further comprising a non-woven batting layer adjacent to the flame resistant layer; and a fabric backing layer adjacent to the non-woven batting layer.

19. The mattress of claim 18, wherein the flame resistant thermoplastic includes amorphous polyetherimide, the fabric layer includes at least one of polypropylene or polyester, the non-woven batting layer includes flame resistant rayon and polyseter, and the fabric backing layer includes polypropylene.

* * * * *

UNITED STATES PATENT AND TRADEMARK OFFICE

CERTIFICATE OF CORRECTION

PATENT NO. : 7,849,542 B2
APPLICATION NO. : 11/472912
DATED : December 14, 2010
INVENTOR(S) : Michael S. DeFranks It is certified that error appears in the above-identified patent and that said Letters Patent is hereby corrected as shown below:

In the Claims:

In Claim 19, column 10, line 54, replace “polyseter” with --polyester--.

Signed and Sealed this
Eighth Day of February, 2011

David J. Kappos

David J. Kappos
*Director of the United States Patent and Trademark Office*